US006196169B1

(12) United States Patent
Schreiner

(10) Patent No.: US 6,196,169 B1
(45) Date of Patent: Mar. 6, 2001

(54) COOLING DEVICE FOR A VEHICLE COMBUSTION MOTOR

(75) Inventor: Emerich Schreiner, Gratwein (AT)

(73) Assignee: Steyr-Daimler-Puch Fahrzeugtechnik AG & Co. KG

( * ) Notice: Subject to any disclaimer, the term of this patent is extended or adjusted under 35 U.S.C. 154(b) by 0 days.

(21) Appl. No.: 09/423,098

(22) PCT Filed: Apr. 30, 1998

(86) PCT No.: PCT/AT98/00114

§ 371 Date: Nov. 1, 1999

§ 102(e) Date: Nov. 1, 1999

(87) PCT Pub. No.: WO98/50689

PCT Pub. Date: Nov. 12, 1998

(30) Foreign Application Priority Data

May 2, 1997 (DE) ..... 197 18 704

(51) Int. Cl.[7] ..... F01P 7/10

(52) U.S. Cl. ..... 123/41.49

(58) Field of Search ..... 123/41.49; 180/68.1

(56) References Cited

U.S. PATENT DOCUMENTS 5,410,992 * 5/1995 Hunt et al. ..... 123/41.49

* cited by examiner

*Primary Examiner*—Willis R. Wolfe
*Assistant Examiner*—Katrina B. Harris
(74) *Attorney, Agent, or Firm*—Bachman & LaPointe, P.C.

(57) ABSTRACT

A cooling apparatus for the internal combustion engine of a motor vehicle includes a cooling-air fan (10), a radiator assembly (2) and a fan shroud (18) which extends from a fan ring (9), enclosing the cooling-air fan, as far as the radiator assembly. In order, with given dimensioning of the radiator assembly (2) and cooling-air fan (10), to increase the cooling capacity, the fan shroud (18) forms, in the part (12) which projects laterally beyond the projection of the cooling-air fan (10), a vertical flow duct (23) and, in the part (11) which projects beyond the radiator assembly (2), a collecting chamber (22) which is in flow connection with the vertical flow duct (23).

5 Claims, 3 Drawing Sheets

COOLING DEVICE FOR A VEHICLE COMBUSTION MOTOR

BACKGROUND OF THE INVENTION

The invention relates to a cooling apparatus for the internal combustion engine of a motor vehicle, comprising a cooling-air fan, a radiator assembly and a fan shroud which extends from a fan ring, enclosing the cooling-air fan, as far as the radiator assembly, the radiator assembly projecting laterally beyond the projection of the cooling-air fan, and the projection of the cooling-air fan projecting upward and/or downward beyond the radiator assembly.

Such a cooling apparatus is described, for example, in DE-A 24 39 033 or also in DE-A 34 04 887. As is customary in vehicles with a longitudinally installed engine, the fan is driven by the latter via a V-belt. It covers over a circular surface, of which the vertical position, on account of the drive, is usually unfavorable and can only be selected within narrow limits. For aerodynamic reasons, it is desirable in modern vehicles to have a bonnet which slopes away sharply. In the case of a certain necessary cooling surface, this necessitates a very wide and low radiator assembly.

The radiator assembly projects beyond the projection of the circular surface of the fan at least on one side (in the case of an asymmetrical arrangement), but usually on both sides, and the circular surface, for its part, projects beyond the top edge of the radiator assembly. The fan shroud has to overcome this unfavorable offset flow, which is barely possible on account of the small axial spacing. This results in regions of the radiator assembly which have insufficient flow passing through them, if any at all, and sectors on the cooling-air fan which receive insufficient flow. These regions and sectors can be seen in DE-A 24 39 033.

The consequence is that the cooling system, in certain critical situations (at a standstill in hot climates, where possible still with the air-conditioning system switched on, traveling on inclines under full load, etc.), fails or has to be safeguarded by complex and costly additional precautionary measures (over-dimensioned parts, additional electric fan, temperature-controlled switch-off of additional heat sources, etc.).

The object of the present invention is to improve a cooling apparatus such that, with given dimensioning of the radiator assembly and cooling-air fan, the cooling capacity is increased, with a minimum of structural outlay. Retrofitting in existing vehicles is to be possible.

SUMMARY OF THE INVENTION

The foregoing object is achieved according to the invention wherein the fan shroud forms, in the part which projects laterally beyond the projection of the cooling-air fan, a vertical flow duct with a cross section which increases in the vertical flow direction and, in the part which projects beyond the projection of the radiator assembly, a collecting chamber, the vertical flow duct merging into the collecting chamber and the collecting chamber being open toward that part of the cooling-air fan which projects beyond the projection of the radiator assembly.

In this way, the regions of the radiator assembly which in accordance with the prior art do not have flow passing through them are in connection, via the vertical flow duct and the collecting chamber, with that sector of the cooling-air fan which receives insufficient flow. Both surfaces are utilized. As a result, merely by using the fan shroud configured according to the invention, the cooling capacity was increased by 8%, in the case of simulated traveling on inclines with a maximum road-train weight, and even by 25%, in the case of idling at a standstill.

Depending on the spatial arrangement of the cooling-air fan and radiator assembly, such a vertical flow duct is provided on both sides or just on one side of the fan ring. The collecting chamber is usually formed above the radiator assembly, but, depending on the arrangement, it may also be formed beneath the radiator assembly or above and beneath.

In a development of the idea of the invention, the collecting chamber may grip over the radiator assembly in the direction oriented away from the cooling-air fan and the vertical flow duct may grip around the fan ring on the outside. This means that, without the installation dimensions being increased, large cross sections of the vertical flow duct and of the collecting chamber can be achieved and the fan shroud may be in a form which is particularly practical in production terms. The bonnet may then be of particularly shallow design.

With a virtually symmetrical arrangement of the radiator assembly and cooling-air fan, a vertical flow duct is arranged on both sides of the fan shroud.

For an optimum development of the invention, the flow cross section of the vertical flow duct is selected such that it increases to the same extent as the covered-over radiator surface. This means that the flow speeds in the duct remain more or less equal, with the result that flow losses are kept to a minimum.

BRIEF DESCRIPTION OF THE DRAWINGS

The invention is explained and described hereinbelow with reference to drawings, in which.

DETAILED DESCRIPTION

Figure 1:
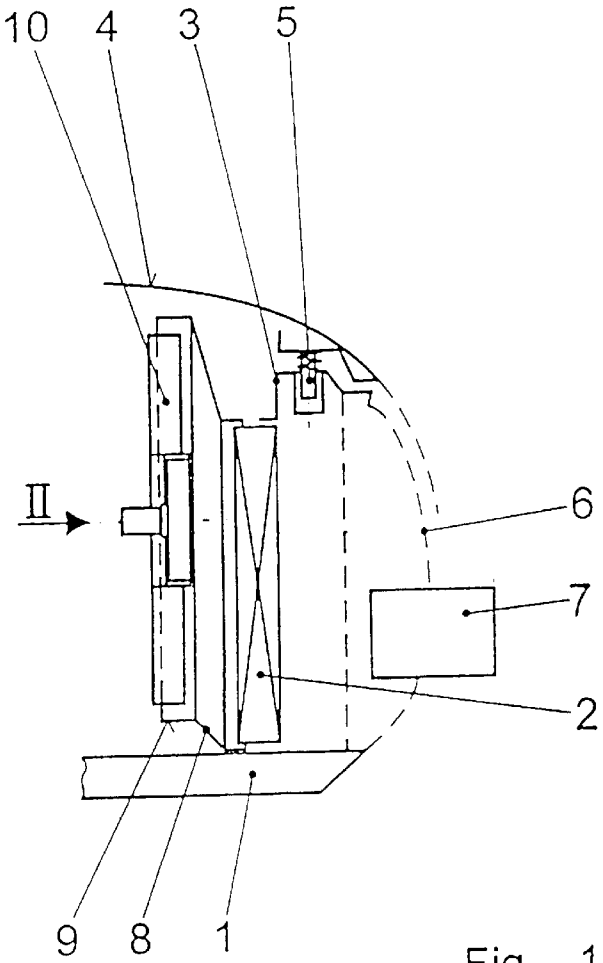
Fig 1 PRIOR ART
FIG. 1 shows schematically, in longitudinal section, a cooling apparatus according to the prior art.
Figure 2:
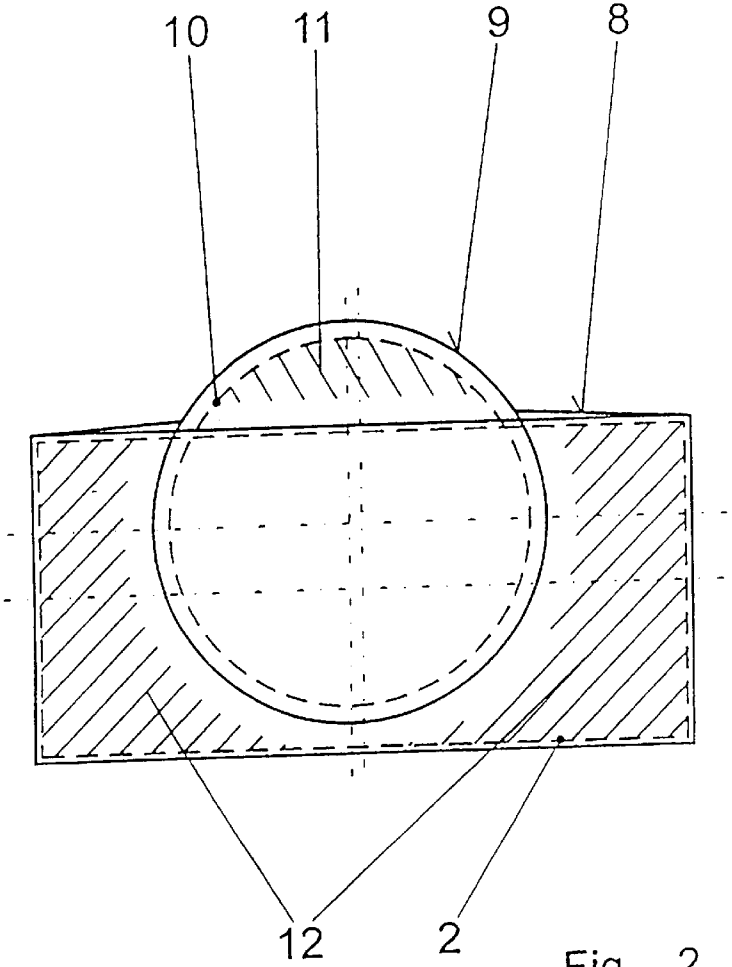
Fig 2 PRIOR ART
FIG. 2 shows a view in accordance with II in FIG. 1.

In FIGS. 1 and 2, the load-bearing structure of the vehicle is represented by a longitudinal member 1. On the latter, a radiator assembly 2 is mounted in a known manner via vibration-damping elements. An engine-compartment panel 3 adjoins the radiator assembly 2 at the top and may, if appropriate, form a partition. It is likewise part of the vehicle structure and serves as a sill for a bonnet 4, which can be locked to the engine-compartment panel 3 by means of a lock 5. A radiator grille 6 and a bumper 7 are only indicated.

A fan shroud 8 according to the prior art extends from a fan ring 9 as far as the rectangular radiator assembly 2. The fan ring 9 encloses, with a certain amount of play, a cooling-air fan 10, an axial-flow fan as usual, which is either fastened on the engine (not illustrated) and driven by the same or is driven by a dedicated drive motor (not illustrated) and is fastened on the fan shroud 8.

It can be seen in FIG. 2 that the part 11 of the surface which is covered over by the fan 10 projects beyond the radiator assembly 2, and that a part 12 of the surface of the radiator assembly is not covered over by the projection of the cooling-air fan 10. The fan shroud 8 thus runs to the sides of the cooling-air fan 10, transversely to the traveling direction in practice, with the result that the part 12 of the radiator assembly 2 does not have flow passing through it in practice.

Figure 3:
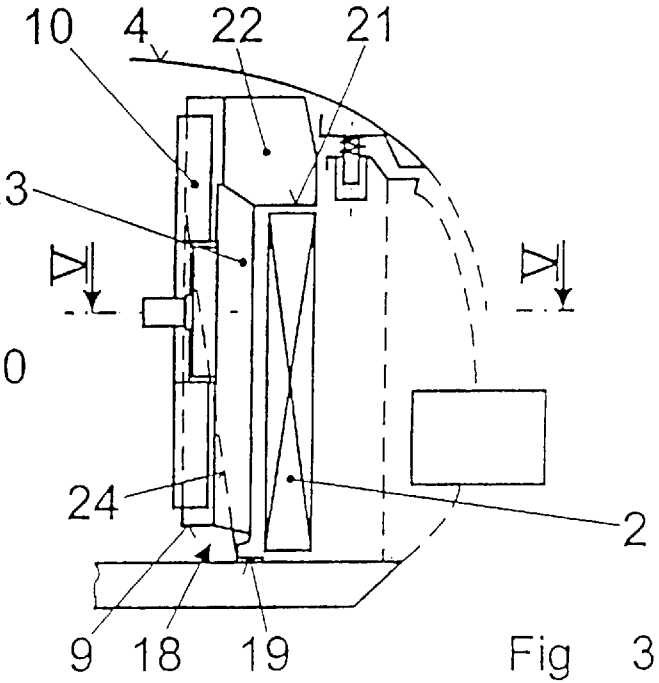
FIG. 3 shows a longitudinal section through a first embodiment of the cooling apparatus according to the invention.
Figure 4:
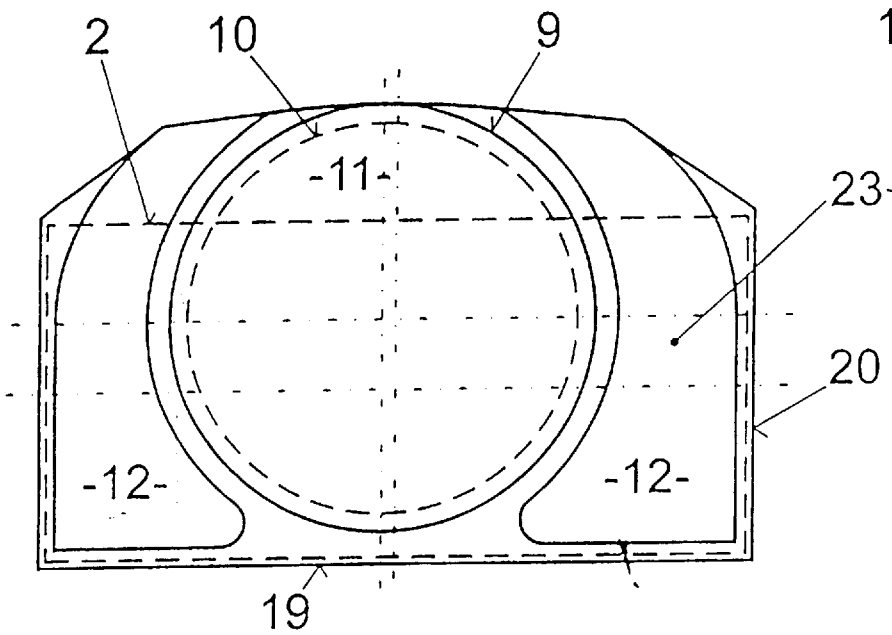
FIG. 4 shows a view in the traveling direction in relation to FIG. 3.
Figure 5:
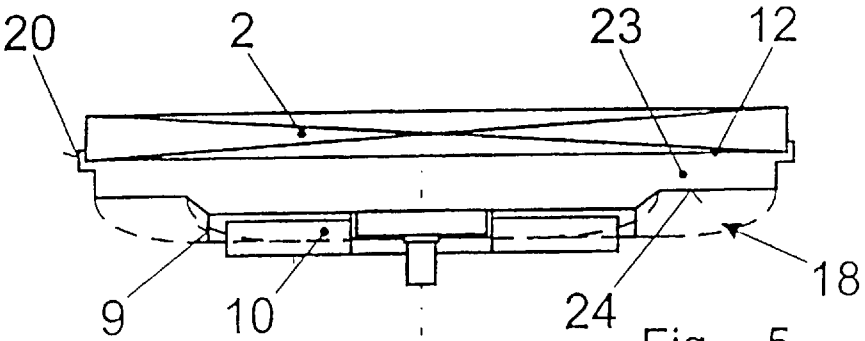
FIG. 5 shows a horizontal section in accordance with V—V in FIG. 3.

In FIGS. 3, 4 and 5, a fan shroud configured according to the invention is designated in general terms by 18. It may be produced from sheet metal or may be a single plastic part. It extends from the circular air shroud 9 as far as the radiator assembly 2. There, it forms a bottom connection border 19, a lateral connection border 20 and a top connection border 21. The fan shroud 18 forms, behind the parts 12 of the radiator assembly 2, a vertical flow duct 23, of which the cross section is determined in each case by its width and depth. The depth is provided by a cover surface 24.

It can be seen in FIG. 3 that the depth of the flow duct 23 increases from bottom to top. In the embodiment shown, in each case one such vertical flow duct is provided on both sides of the fan 10. At the top, said flow duct opens out into a collecting chamber 22, which grips over the radiator assembly 2 toward the front. As a result, it may be configured such that the air conveyed in the flow ducts 23 can be deflected and fed to the projecting part 11 of the surface which is covered over by the cooling-air fan 10.

Figure 6:
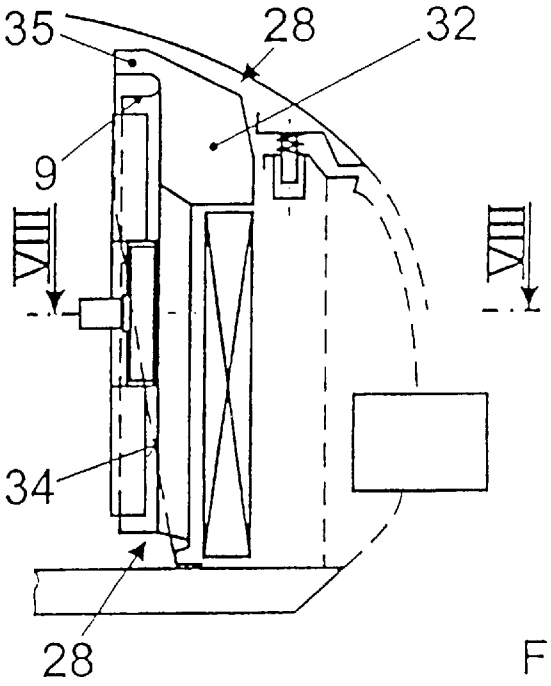
FIG. 6 shows a longitudinal section through a second embodiment of the cooling apparatus according to the invention.
Figure 7:
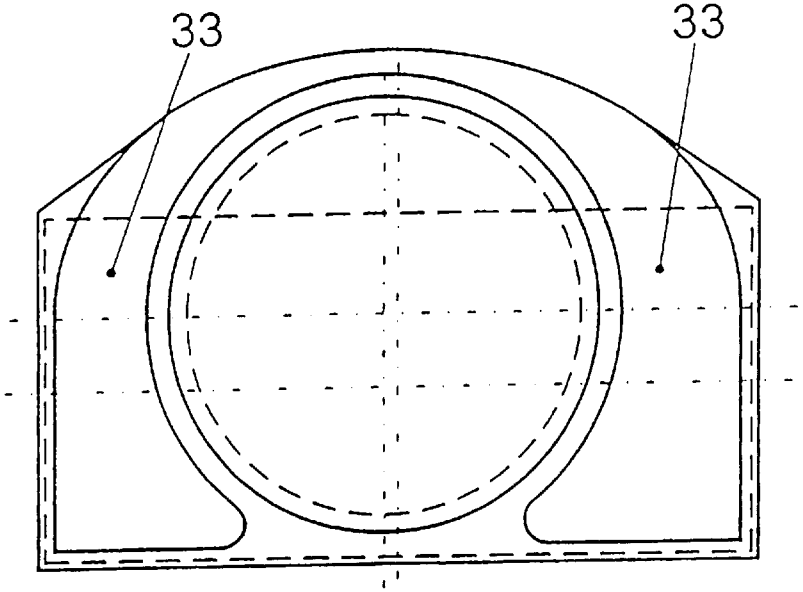
FIG. 7 shows a view in the traveling direction in relation to FIG. 6.
Figure 8:
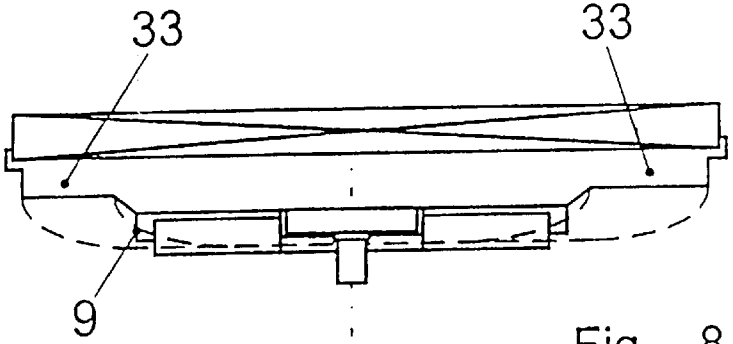
FIG. 8 shows a horizontal section in accordance with VIII—VIII in FIG. 6.

The modified embodiment according to FIGS. 6, 7 and 8 differs from the preceding embodiment in that the fan shroud 28 forms a collecting chamber 32 which is enlarged by an additional chamber 35. This is formed in that the vertical flow ducts 33 enclose the fan ring 9 to the full extent. The flow ducts 33 may be of deeper design; the position of the cover surface 34 is indicated by way of example in FIG. 6.

The fan shrouds configured according to the invention make it possible, without increasing the distance between the radiator assembly 2 and fan 10, for the entire surface of the radiator assembly 2 to have flow passing through it effectively, irrespective of the position of the axis of the cooling-air fan 10 and of the position of the radiator assembly 2. In each case, the cross-sectional progressions of the vertical flow ducts, within the context of the rules relating to fan construction, can be adapted to the aerodynamic requirements.

What is claimed is:

1. Cooling apparatus for the internal combustion engine of a motor vehicle, comprising a cooling-air fan (10), a radiator assembly (2) and a fan shroud which extends from a fan ring (9), enclosing the cooling-air fan, as far as the radiator assembly, the radiator assembly projecting laterally beyond the projection of the cooling-air fan, and the projection of the cooling-air fan projecting upward and/or downward beyond the radiator assembly, wherein the fan shroud (18; 28) forms, in the part (12) which projects laterally beyond the projection of the cooling-air fan (10), a vertical flow duct (23; 33) and, in the part (11) which projects beyond the radiator assembly (2), a collecting chamber (22; 32, 35) which is in flow connection with the vertical flow duct (23; 33) and is open toward the cooling-air fan (10).

2. Cooling apparatus according to claim 1, wherein the collecting chamber (22; 32, 35) grips over the radiator assembly (2) toward the front in the longitudinal direction of the vehicle.

3. Cooling apparatus according to claim 1, wherein the vertical flow duct (33) grips around the fan ring (9) on the outside.

4. Cooling apparatus according to claim 1, wherein a vertical flow duct (23; 33) is arranged on both sides of the fan shroud (18; 28).

5. Cooling apparatus according to claim 1, wherein the flow cross section of the vertical flow duct (23; 33) increases to the same extent as the covered-over surface of the radiator assembly (2).

* * * * *